US006776575B2

(12) United States Patent
Tuck, Jr.

(10) Patent No.: US 6,776,575 B2
(45) **Date of Patent: *Aug. 17, 2004**

(54) NUTATING CENTRIFUGAL PUMP

(76) Inventor: Alan D. Tuck, Jr., 2829 Wilfred Reid Cir., Sarasota, FL (US) 34240

( * ) Notice: Subject to any disclaimer, the term of this patent is extended or adjusted under 35 U.S.C. 154(b) by 104 days.

This patent is subject to a terminal disclaimer.

(21) Appl. No.: 10/256,654

(22) Filed: Sep. 27, 2002

(65) Prior Publication Data

US 2003/0026687 A1 Feb. 6, 2003

Related U.S. Application Data

(62) Division of application No. 09/861,456, filed on May 18, 2001, now Pat. No. 6,506,012.

(51) Int. Cl.[7] ..... F04D 33/00
(52) U.S. Cl. ..... 415/170
(58) Field of Search ..... 415/70, 119; 416/144, 416/145, 500

(56) References Cited

U.S. PATENT DOCUMENTS

| | | | | |
|---|---|---|---|---|
| 414,642 | A | 11/1889 | Herrick | 74/573 R |
| 2,107,090 | A | 2/1938 | Swennes | 103/111 |
| 2,759,427 | A | 8/1956 | Holstein | 103/83 |
| 3,724,904 | A | 4/1973 | Nixon et al. | 301/5 BA |
| 6,506,012 | B2 * | 1/2003 | Tuck, Jr. | 415/70 |

FOREIGN PATENT DOCUMENTS

| | | |
|---|---|---|
| BE | 52095 | 11/1956 |
| JP | 4-164186 | 6/1992 |

* cited by examiner

*Primary Examiner*—Edward K. Look
*Assistant Examiner*—Dwayne J White
(74) *Attorney, Agent, or Firm*—Fulbright & Jaworski L.L.P.

(57) ABSTRACT

A pump employing a nutating plate within a chamber impels fluid flow from an axial inlet to a peripheral outlet. The chamber extends 360° and the plate has holes about the axis thereof such that both sides of the plate can operate to impel fluid through the chamber. A dynamic balancing system which may include two dynamic balancing rings with multiple weights therein act to overcome eccentricities and vibrational moments.

21 Claims, 8 Drawing Sheets

NUTATING CENTRIFUGAL PUMP

This application is a divisional of U.S. patent application Ser. No. 09/861,456, filed May 18, 2001, now U.S. Pat. No. 6,506,012, the disclosure of which is incorporated herein by reference.

BACKGROUND OF THE INVENTION

The field of the present invention is pumps employing a wobble plate.

Pumps have been developed which employ wobble plates that exhibit nutation. Where a diaphragm is employed with such a wobble plate, a peristaltic pump characteristic results. Reference is made to U.S. Pat. No. 5,466,133 and U.S. Pat. No. 5,529,468, the disclosures of which are incorporated herein by reference. Where no diaphragm is present, the wobble plate has been employed to generate rotational motion with both the inlet and the outlet about the periphery of the plate chamber. Reference is made to U.S. Pat. No. 2,693,764. These pumps act as positive displacement pumps with at least one partition across the pumping chamber. The inlet is found on one side of the partition while the outlet is on the other. The wobble plate sweeps the cavity progressively between inlet and outlet.

The nutation, or wobble, of a plate, in the context of the aforementioned patents, is accomplished by rotating a mounting for the plate about an axis of nutation. This axis is angularly displaced from the normal central axis of the plate with these axes preferably intersecting near the plate. The term "nutation" is used here to describe this motion of a plate. The plates in the patents are rotatably mounted relative to the mountings about the normal central axes of the plates such that the plates are able to be constrained from rotation and provide non-rotational nutation. With non-rotational nutation of a plate, any given point on the plate can be observed to move in a plane including the axis of nutation. Angularly adjacent points on the plate move progressively, out of phase with one another to provide the nutation, or wobble. Such plate motion within a cavity creates progressive squeezing and expanding between the sides of the plate and the adjacent cavity walls about the axis of nutation. This action within the cavity results in fluid rotational flow about the axis of nutation. This response is understood to be applicable as a pumping force.

A Tesla pump is another type of pump employing one or more plates. The Tesla pump usually has two parallel plates spaced closely together and rotated about their coincident normal central axes. The plates include an axial inlet to between the plates and a peripheral outlet. The pumping force is friction between the rotating plates and the fluid therebetween which, in turn, induces circular motion and centrifugal force.

SUMMARY OF THE INVENTION

The present invention is directed to a pump including a plate mounted for nutation within a cavity. With an inlet and an outlet from the cavity, the nutation accomplishes pumping of fluid through the cavity. The nutation may be non-rotational.

In a first separate aspect of the present invention, a dynamic balancing system rotates about the axis of nutation. Such a balancing system may include a balancing ring with movable weights therein. A second balancing ring axially displaced from the first may be provided to respond to moment forces. Additionally, a counterweight may also be employed for first order balancing about the shaft.

In a second separate aspect of the present invention, a bellows shaft seal is located about the drive coupling which is fixed to the plate mounted for nutation. The seal extends longitudinally of the drive coupling across the center of nutation and extends from the drive coupling to the chamber housing.

In a third separate aspect of the present invention, a drive coupling is fixed to the plate mounted for non-rotational nutation. The drive coupling includes two shaft sections telescoping together. A compression spring is located between the shaft sections. The compression spring may have the capability of biasing the components of a spherical mounting system toward one another.

In an fourth separate aspect of the present invention, any of the foregoing separate aspects are contemplated to be combined for advantageous result.

Accordingly, it is an object of the present invention to provide an improved pumping system. Other and further objects and advantages will appear hereinafter.

DETAILED DESCRIPTION OF THE PREFERRED EMBODIMENTS

Figure 1:
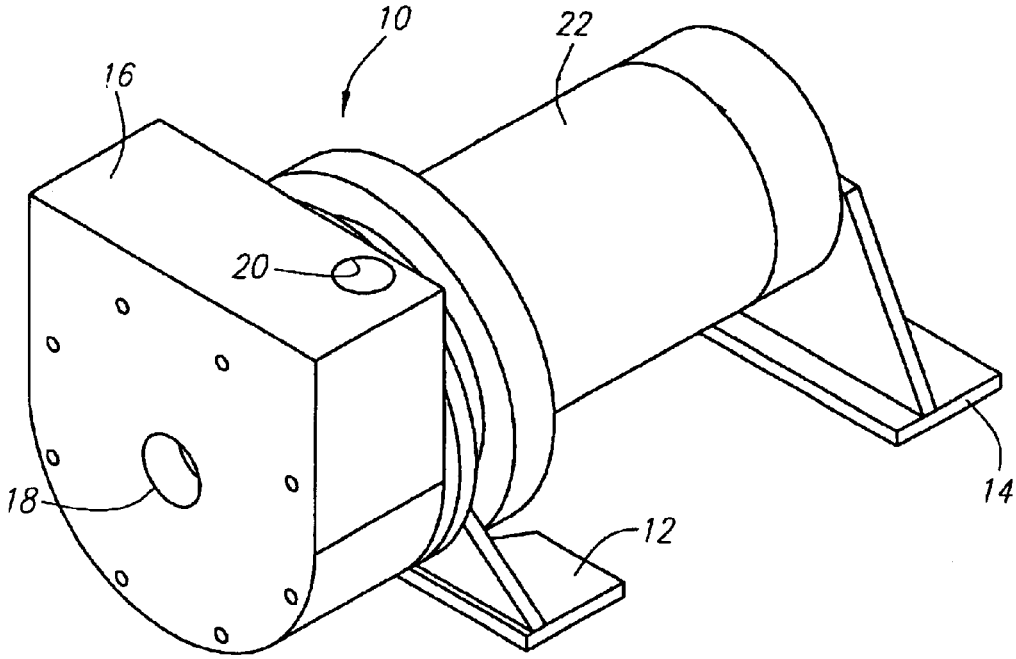
FIG. 1 is a perspective view of a pump.
Figure 2:
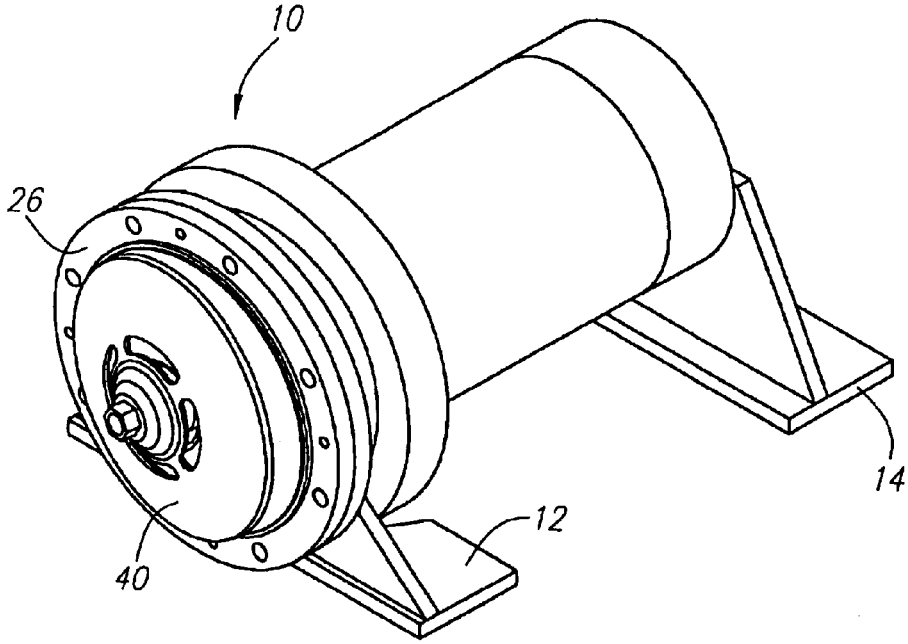
FIG. 2 is a perspective view of the pump of FIG. 1 with the pump case removed.

Turning in detail to the drawings, FIG. 1 illustrates a pump, generally designated 10, having supports 12 and 14. The pump includes a chamber housing 16 having an inlet port 18 and an outlet port 20. A shaft housing 22 is rigidly fixed to the chamber housing 16. The shaft housing 22 in this embodiment will be shown to include a shaft rotatably mounted in bearings extending therethrough. It is possible that the shaft housing 22 may be replaced by a motor with the shaft therethrough being an armature. FIG. 2 provides substantially the same detail as FIG. 1 with the removal of a portion of the chamber housing 16 to disclose a wobble plate contained therein.

Figure 3:
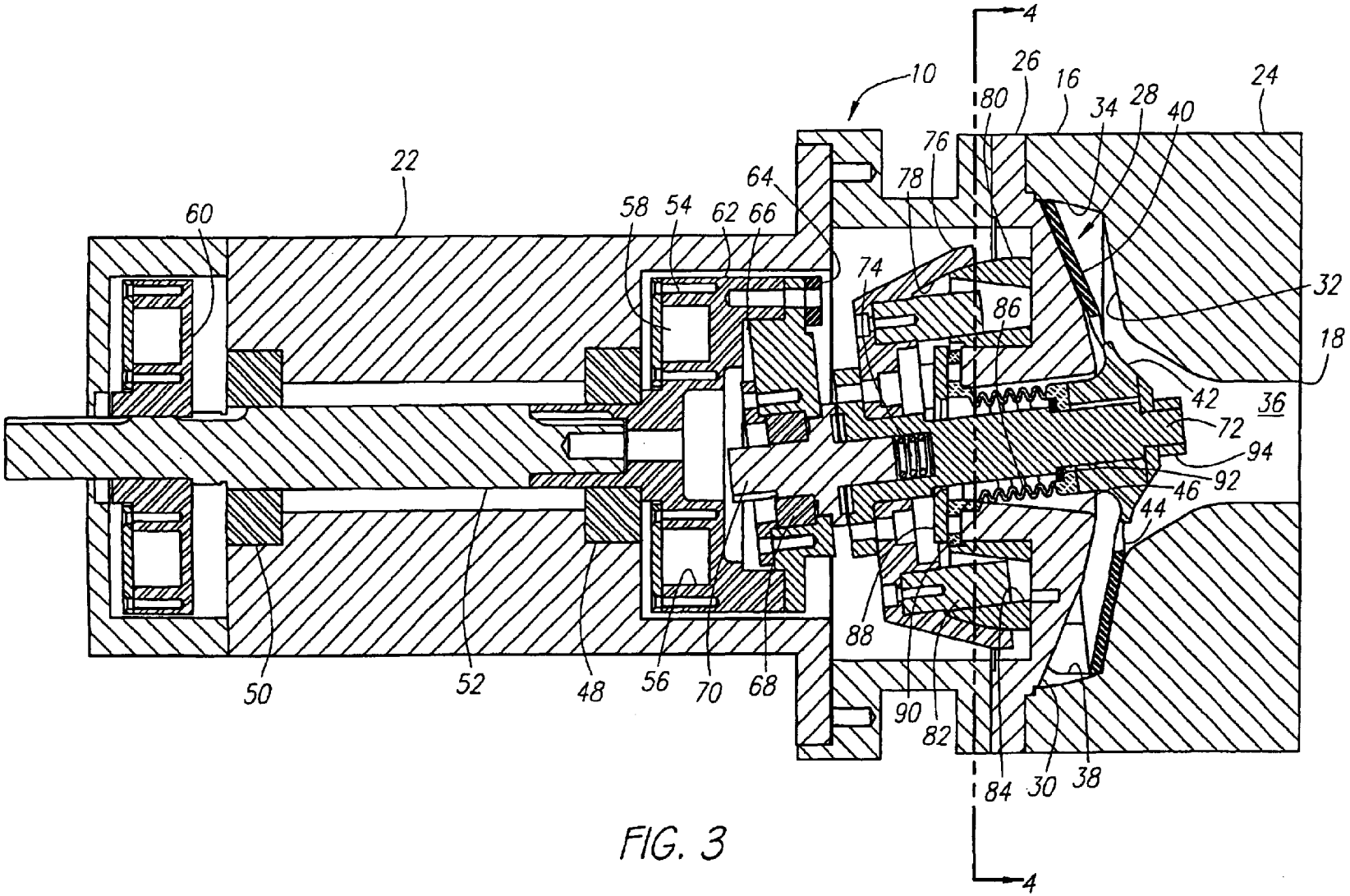
FIG. 3 is a longitudinal cross section of the pump of FIG. 1.
Figure 4:
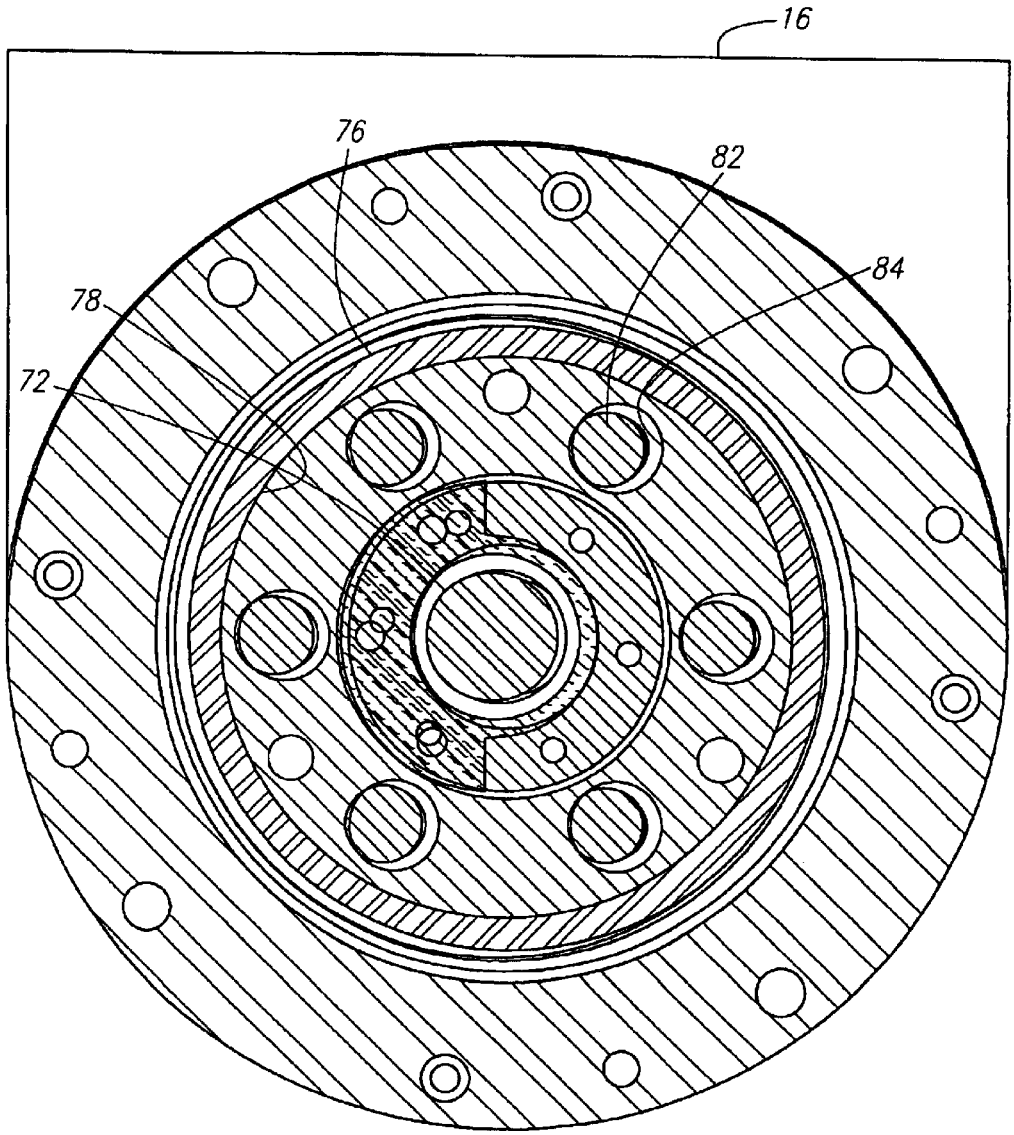
FIG. 4 is a cross-sectional view taken along line 4—4 of FIG. 3.

Turning to the cross-sectional view of FIG. 3, a first embodiment is illustrated in detail. The wall thicknesses are shown to be substantial in this prototype design. Thinner sections are contemplated for production components. The chamber housing 16 is illustrated to be of two parts, an outer housing 24 and an inner housing 26. The outer housing 24 and the inner housing 26 are shown assembled to create a chamber 28 which forms a means for receiving the fluid to be pumped. The chamber 28 includes a first surface 30, an opposed second surface 32 and a circular periphery 34. Thus, the chamber 28 is substantially circular. It extends continuously 360° about a central axis which will be shown to be the axis of nutation. There is no partition to prevent the fluid within the chamber 28 from circulating fully about this axis.

An axial inlet 36 from the inlet port 18 is associated with the chamber 28. The axial inlet provides means for directing the fluid to the chamber at the center of the chamber. A peripheral outlet 38 extends to the outlet port 20 from about the periphery of the chamber 28. The peripheral outlet 38 provides a means for directing fluid from the chamber.

Figure 5:
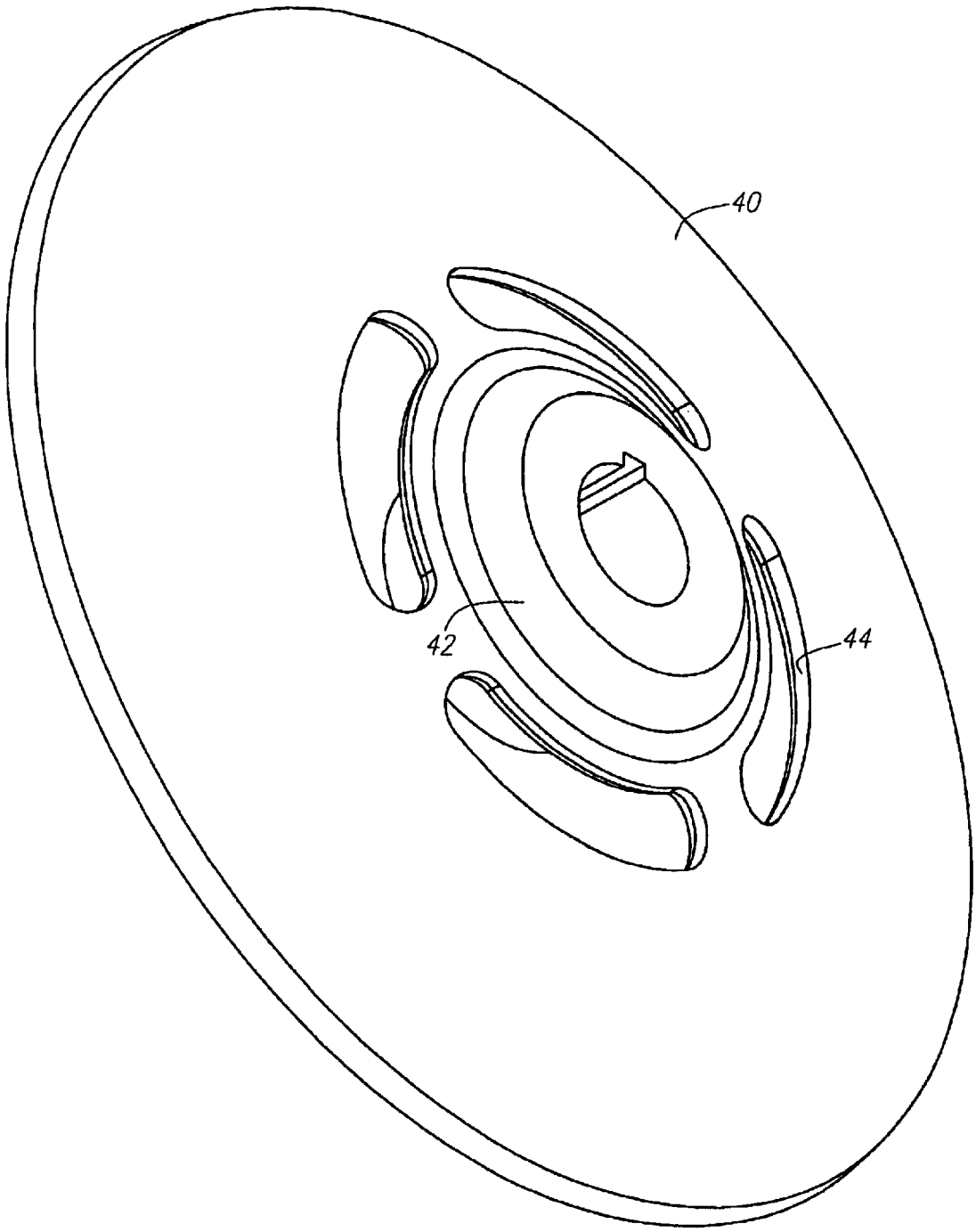
FIG. 5 is a perspective view of a wobble plate.

A wobble plate 40 is found within the chamber 28 to provide a means for impelling fluid through motion of the plate. This impeller element, or wobble plate 40, is shown to be slightly dished to increase the resistance to flutter. The plate 40 includes an attachment hub 42 centrally mounted of the plate at the normal central axis thereof. Holes 44, as best seen in FIG. 5, provide a means for passing incoming fluid from the axial inlet 36 through the plate 40. The holes are radially adjacent to the attachment hub 42. As can be seen in FIG. 3, these holes 44 extend radially to substantially the same extent as the axial inlet 36 at the chamber 28. The plate 40 is also substantially circular so as to closely approximate the circular periphery 34 of the chamber 28. The wobble plate 40 is mounted to nutate about a central axis of nutation within the chamber 28. As such, the chamber surface 30 and the opposed chamber surface 32 as well as the circular periphery 34 approximate the loci of points of extreme axial movement of the plate 40 in nutation. An access port 46 extends through the inner housing 28 for the mounting of the plate 40.

The action of nutation of the plate 40 within the chamber 28 is understood to create a centrifugal force through the rotation of the fluid impelled by the plate 40. This pumping action draws fluid through the axial inlet 36. As the motion of the plate 40 and its interaction with the surfaces 30 and 32 operate to impel fluid, the holes 44 feed the backside of the plate from the axial inlet 36. Thus, a double-acting operation is achieved, by the two sides of the plate 40, to impel fluid to the peripheral outlet 38 through physical displacement of the fluid by nutation of the plate.

The shaft housing 22 is also disclosed in the cross section of FIG. 3. The shaft housing 22 includes mounting bearings 48 and 50 which rotatably mount a drive shaft 52. A dynamic balancing means for reducing vibration in the drive system is mounted to rotate with the drive shaft 52. This dynamic balancing means employs a first dynamic balancing ring 54 at one end of the shaft 52 and constrained to rotate therewith. This dynamic balancing ring 54 includes a centrifugal guide-way 56 containing a plurality of weights movable within the guide-way 56. This means for dynamic balancing allows the weights 58 to naturally assume a balancing orientation when rotated. A second means for dynamic balancing includes a second dynamic balancing ring 60 having weights as well is located at a position displaced from the first dynamic balancing ring 54. At this location, the two balancing rings 54 and 60 can provide a moment in response to certain dynamic vibrations. The first dynamic balancing ring 54 is shown to be mounted on a rotor 62 which is attached at one end of the drive shaft 52 so as to rotate therewith. The rotor 62 supports a counterweight 64 which is radially displaced from the axis of nutation and the coincident axis of rotation of the drive shaft 52. The counterweight 64 is arranged diametrically from the unbalanced weight of the drive coupling.

A drive plate 66 is bolted to the rotor 62. The drive plate 66 is shown to be asymmetrical to provide an inclined and radially offset mounting for a bearing 68. The drive plate 66 rotates with the rotor 62 about the axis of nutation coincident with the axis of rotation of the drive shaft 52. Even so, the bearing 68 defines the normal central axis of the wobble plate 40. This normal central axis of the plate 40 is preferably angularly displaced about 4° to 6° from the axis of nutation with the two axes intersecting at the center of nutation, near the plate. The bearing 68 is employed because the wobble plate 40 and the associated drive coupling are constrained from rotation.

A drive coupling rotatably mounted in the bearing 68 of the drive plate 66 extends to and is fixed to the plate 40. The drive coupling provides means for nutation of the plate. The drive coupling is defined by two shaft sections 70 and 72 telescoping together. The shaft section 70 is mounted within the bearing 68 while the shaft section 72 is fixed to the plate 40. The shaft sections 70 and 72 extend along the normal central axis of the plate 40. This normal central axis is angularly displaced from the axis of nutation, as noted above, and at the intersection of the two the center of nutation is defined. The shaft sections 70 and 72 may incorporate a spring 74 therebetween. The spring 74 is maintained in some compression to effect an appropriate seating of the drive coupling in the supporting bearing.

A spherical mounting is employed to mount the drive coupling and in turn the plate 40. The spherical mounting in the embodiment of FIG. 3 includes a mounting block 76 having a spherical seat 78. The spherical seat has a center of curvature located at the center of nutation. A spherical bearing 80 seats within the spherical seat 78. The mounting block 76 is shown in the embodiment of FIG. 3 to be mounted to the shaft section 72 while the spherical bearing 80 is mounted to the inner housing 26.

To constrain the plate 40 from rotation, rotational stop elements are employed. In this embodiment, the rotational stop elements include pins 82 and guide-ways 84. The guide-ways 84 are shown to be tapered so as to accommodate the nutation of the system in engagement with the pins 82. The pins 82 may be of low friction or self lubricating material.

A bellows shaft seal 86 is located about the center of nutation. This seal 86 extends from the shaft section 72 to the inner housing 26 about the access port 46. The seal 86 is held in place at the inner housing 26 by a circular plate 88 bolted to the inner housing 26 to place a flange 90 on the bellows shaft seal 86 in compression. At the shaft section 72, the bellows shaft seal 86 is compressed between a washer 92 resting against a shoulder on the shaft section 72 and the hub 42. The hub is held to the shaft section 72 in compression against the bellows shaft seal 86 by a threaded nut 94. By locating the bellow shaft seal 86 about the center of nutation, the shaft seal finds its minimum amount of deflection. As there is no rotation of the plate 40, the bellow shaft seal 86 has no sliding seal, resulting in the entire chamber being statically sealed to significant advantage.

Figure 6:
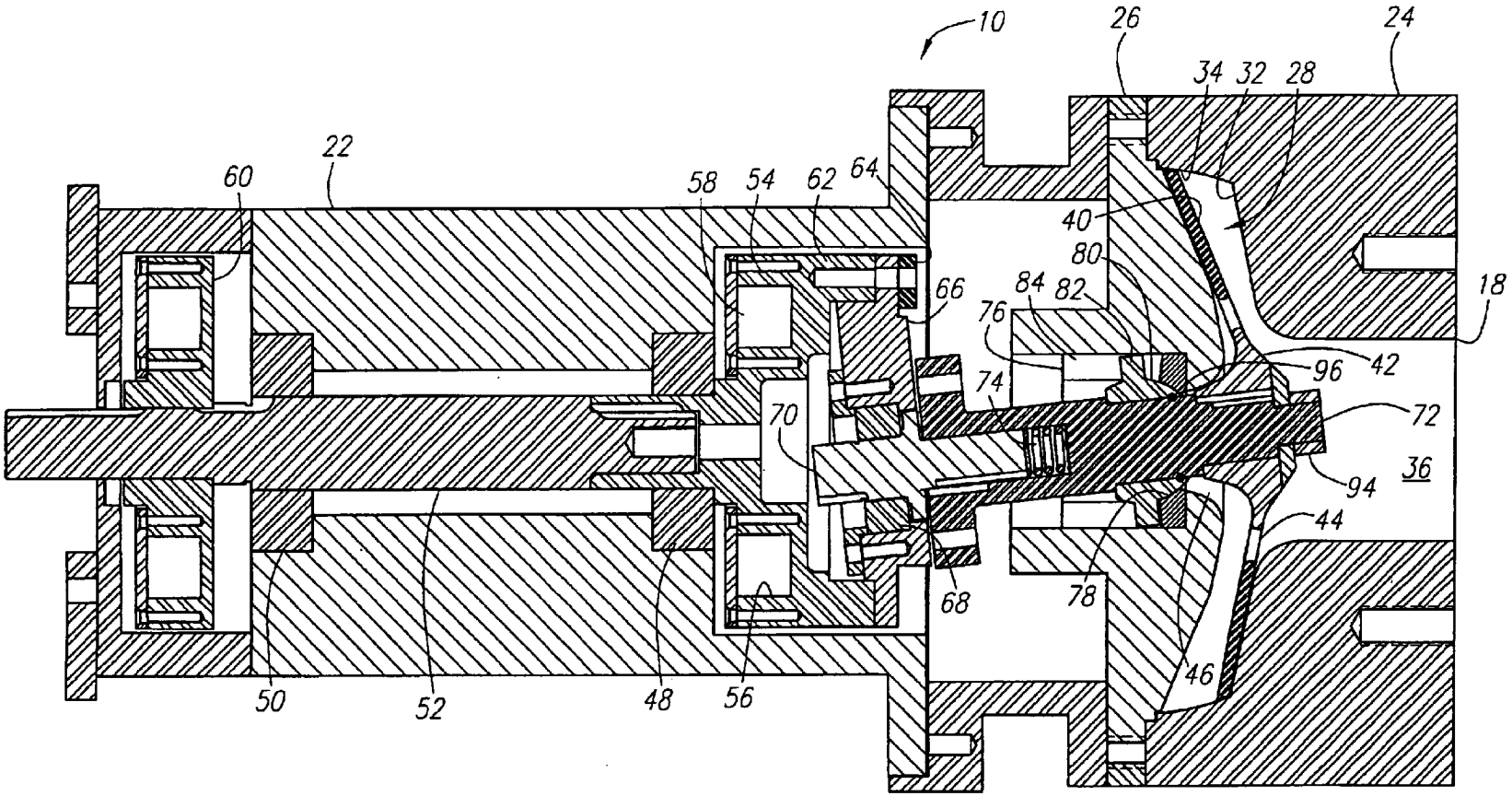
FIG. 6 is a longitudinal cross section as in FIG. 3 illustrating a second embodiment.
Figure 7:
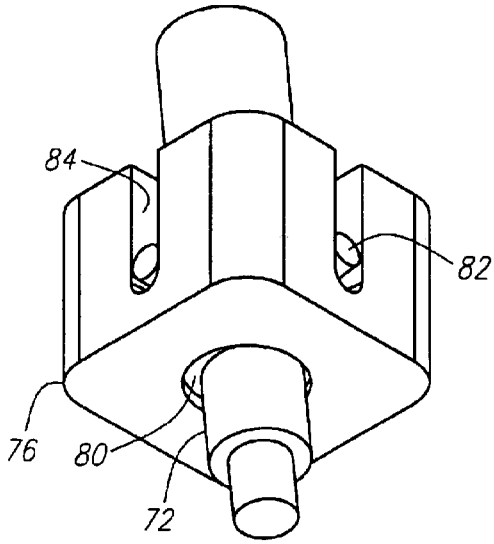
FIG. 7 is a perspective view of a spherical bearing as used in the embodiment of FIG. 6.
Figure 8:
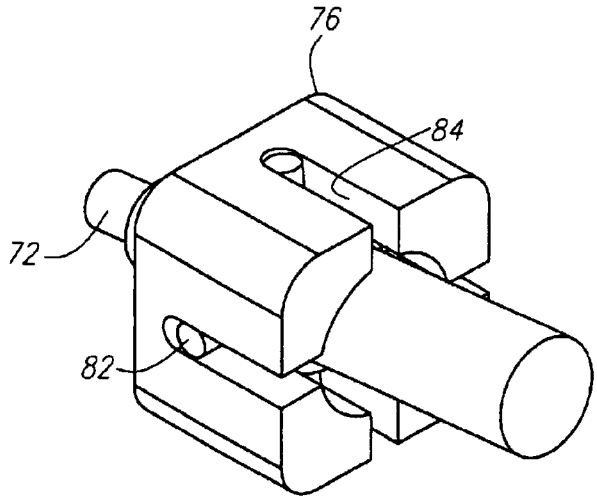
FIG. 8 is a second perspective view of the spherical bearing of FIG. 7.

Further embodiments are also contemplated. These embodiments focus on variations in the spherical mounting with overall principles of the pump remaining the same. Identical reference numbers in the embodiments reflect corresponding, if not identical, components. In the second embodiment illustrated in FIGS. 6, 7 and 8, the spherical mounting is shown to be located immediately about the drive coupling. A mounting block 76 is fixed in this instance to the inner housing 26. The mounting block 76 includes a spherical seat 78 having a center of curvature at the center of nutation. A spherical bearing 80 mates with the spherical seat 78 of the mounting block 76 to define the seal, in this case dynamic. An O-ring 96 provides sealing between the spherical bearing 80 and the shaft section 72. The rotational stop elements include pins 82 and guide-ways 84 which each lie in a plane which includes the axis of nutation. The pins 82 and guide-ways 84 are engaged to keep the plate 40 from rotating.

Figure 9:
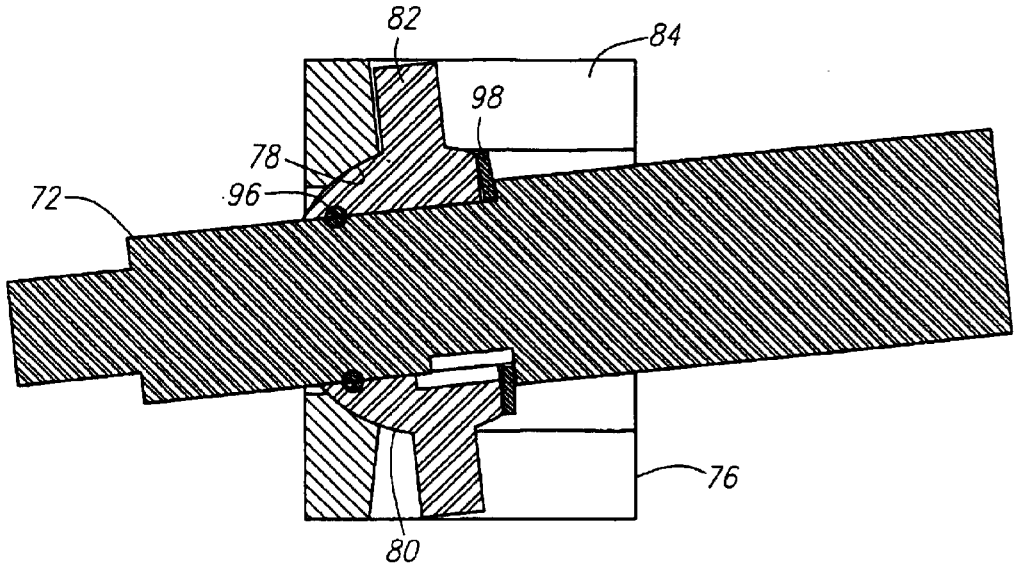
FIG. 9 is a cross-sectional side view of the spherical bearing of FIG. 7.

A variation is illustrated in the detail of FIG. 9. The spherical bearing 80 is slidably mounted on a single piece shaft section 72 and is thrust forward by a plate spring 98. The plate spring 98 provides resilience to the seating of the spherical bearing and similarly biases the wobble plate 40 as positioned in the bearing. The plate spring 98 provides less displacement and a higher spring constant than the coil compression spring 74.

Figure 10:
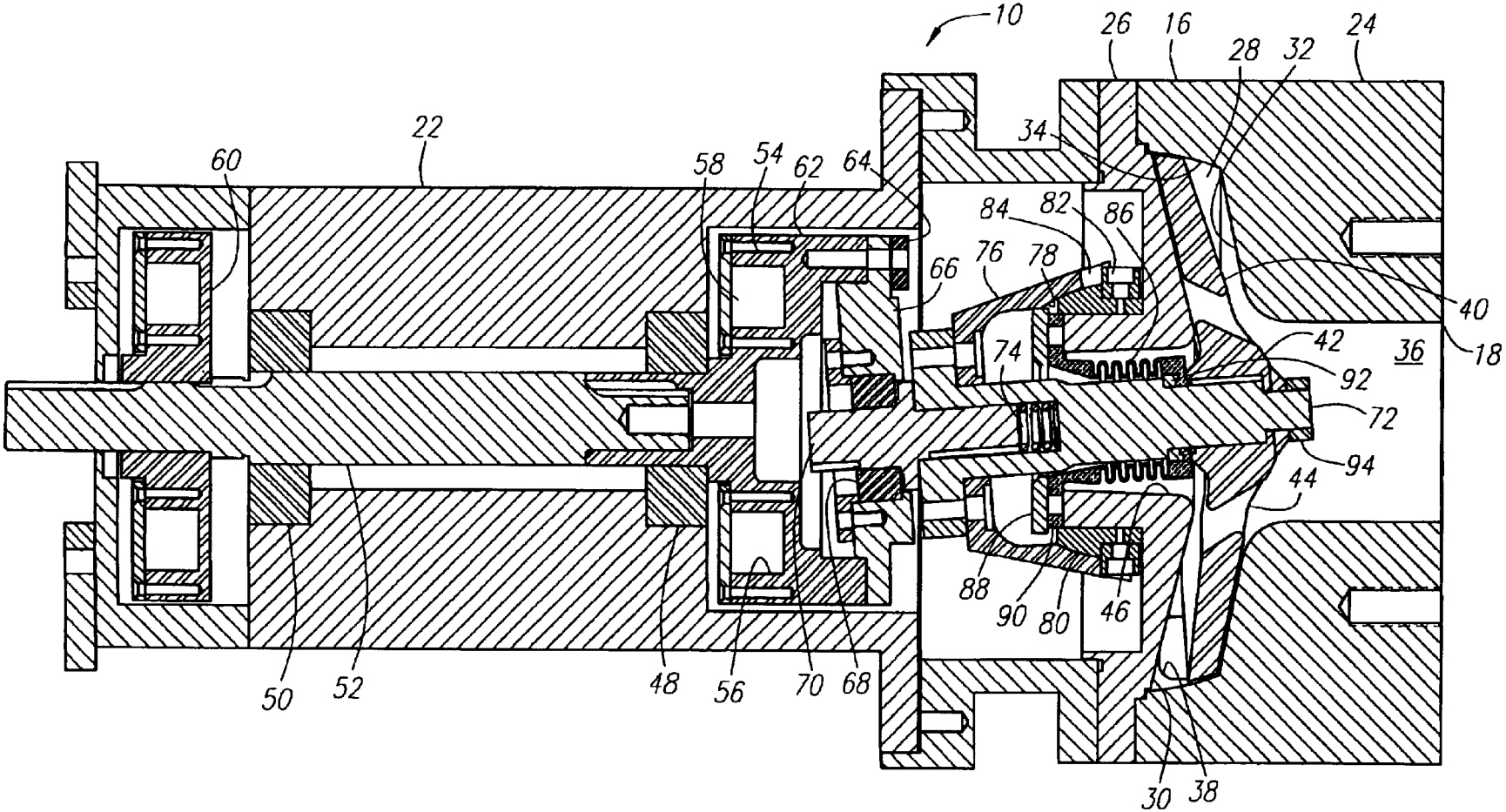
FIG. 10 is a longitudinal cross section as in FIG. 3 illustrating a third embodiment.
Figure 11:
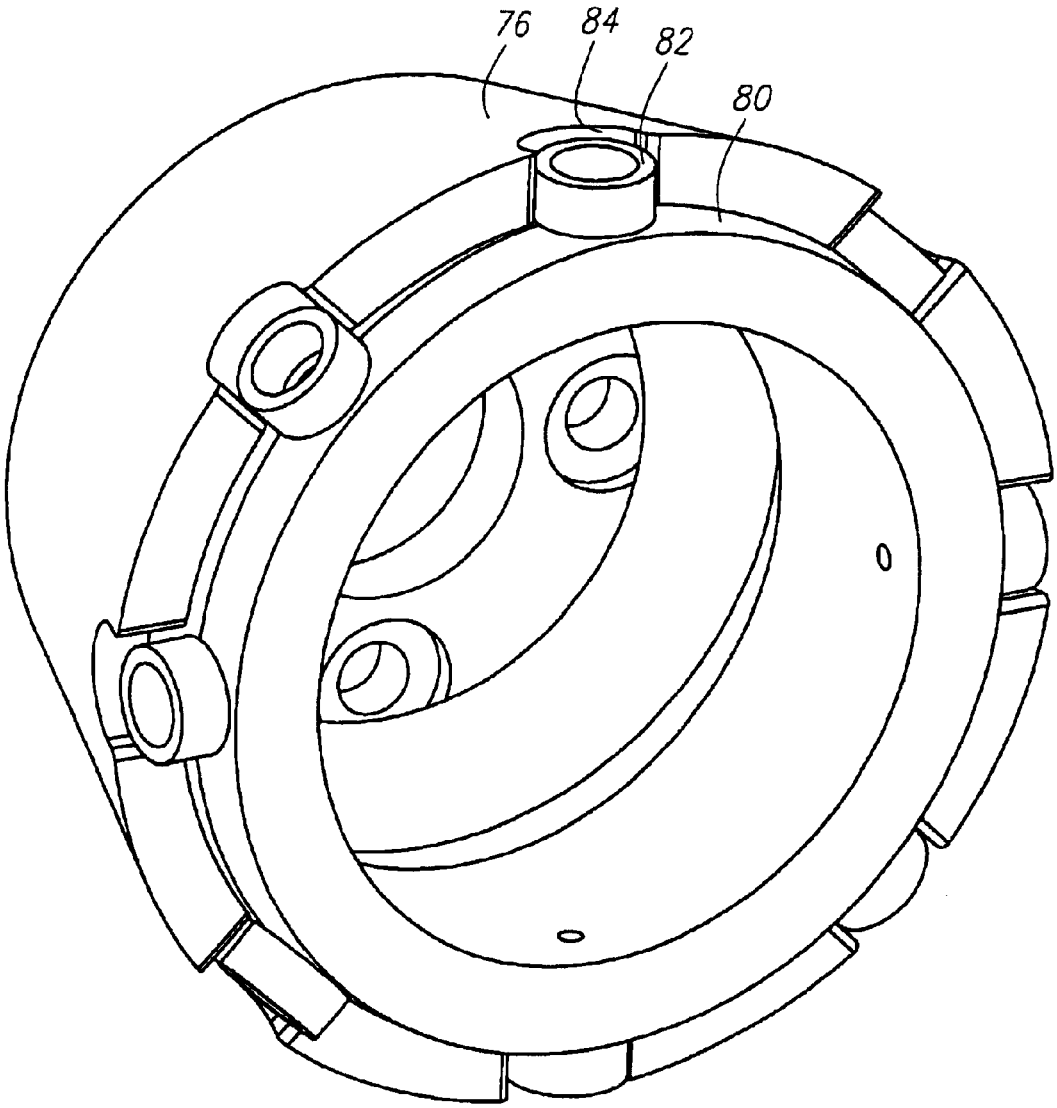
FIG. 11 is a subassembly of a spherical bearing of the embodiment of FIG. 10 in perspective.

A further embodiment is illustrated in FIGS. 10 and 11. A mounting block 76 is fixed to the shaft 70 of the drive coupling. The mounting block 76 includes a spherical seat 78 having a center of curvature at the center of nutation. A spherical bearing 80 fixed to the inner housing 26 of the chamber housing 16 is engaged with the spherical seat 78 of the mounting block 76. The rotational stop elements include pins 82 and guide-ways 84 which each lie in a plane which includes the axis of nutation. The pins 82 and guide-ways 84 are engaged to keep the plate 40 from rotating. The pins 82 are defined by rotatable bearings. A bellows shaft seal 86 is accommodated to define a static seal.

Thus, am improved pumping mechanism is disclosed employing a nutating plate to impel centrifugal fluid flow. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A pump comprising a chamber housing including a chamber, an axial inlet to the chamber and a peripheral outlet from the chamber;

a plate mounted for nutation within the chamber about an axis of nutation;

a shaft housing fixed relative to the chamber housing;

a drive shaft rotatably mounted in the shaft housing about the axis of nutation;

a drive coupling fixed to the plate;

a rotor fixed to rotate with the drive shaft about the axis of nutation, the drive coupling being rotatably mounted to the rotor radially displaced from the axis of nutation;

a first dynamic balancing ring including multiple weights movable within the first dynamic balancing ring at the rotor and rotating therewith.

2. The pump of claim 1 further comprising a second dynamic balancing ring at the drive shaft and rotatable therewith and displaced from the first dynamic balancing ring.

3. The pump of claim 2, the rotor being counterweighted radially displaced from the axis of nutation diametrically from the drive coupling rotatably mounted to the rotor.

4. A pump comprising a plate means for impelling fluid being substantially circular and mounted for nutation about an axis of nutation;

a drive means coupled with the plate means for nutation of the plate means;

a chamber housing including a substantially circular chamber means for receiving the fluid extending continuously 360° about the axis of nutation, an inlet means for directing the fluid to the chamber and an outlet means for directing fluid from the chamber, the inlet means being axial and the outlet means being peripheral to the chamber means, the plate means being within the chamber means, the plate means being constrained from rotation;

a dynamic balancing means rotating with the drive means about the axis of nutation for reducing vibration in the drive means.

5. The pump of claim 4, the drive means including a drive shaft, the dynamic balancing means including a first means for dynamic balancing at the drive shaft and rotatable therewith and a second means for dynamic balancing at the drive shaft and rotatable therewith and displaced from the first dynamic balancing means.

6. The pump of claim 5, the drive means being counterweighted radially displaced from the axis of nutation.

7. A pump comprising a chamber housing including a chamber, an axial inlet to the chamber and a peripherial outlet from the chamber;

a plate mounted for nutation within the chamber about an axis of nutation through a center of nutation, the center of nutation being displaced along the axis of nutation from the plate;

a drive coupling fixed to the plate;

a bellows shaft seal about the drive coupling extending longitudinally of the drive coupling across the center of nutation and from the drive coupling to the chamber housing.

8. The pump of claim 7, the plate including an attachment hub concentrically positioned in the plate and holes radially adjacent to the hub and extending through the plate, the drive coupling being fixed to the attachment hub.

9. The pump of claim 7, the plate being mounted for non-rotational nutation.

10. The pump of claim 9 further comprising a shaft housing fixed relative to the chamber housing;

a drive shaft rotatably mounted in the shaft housing about the axis of nutation;

a rotor fixed to rotate with the drive shaft about the axis of nutation, the drive coupling being rotatably mounted to the rotor radially displaced from the axis of nutation.

11. A pump comprising a chamber housing including a chamber, an axial inlet to the chamber and a peripheral outlet from the chamber;

a plate mounted for non-rotational nutation within the chamber about an axis of nutation through a center of nutation, the center of nutation being displaced along the axis of nutation from the plate;

a drive coupling including two shaft sections telescoping together, the plate being fixed to a first of the two shaft sections;

a compression spring between the two shaft sections;

a mounting for mounting the drive coupling for nutation of the plate within the chamber about an axis of nutation, the mounting including a first portion fixed relative to the chamber housing and a second portion fixed relative to the first of the two shaft sections;

a drive engaged with the second of the two shaft sections.

12. The pump of claim 11 further comprising a bellows shaft seal about the drive coupling extending longitudinally of the drive coupling across the center of nutation and from the drive coupling to the chamber housing.

13. The pump of claim 12, the compression spring biasing the first portion and the second portion together.

14. A pump comprising a chamber housing including a chamber, an axial inlet to the chamber and a peripherial outlet from the chamber;

a plate mounted for non-rotational nutation within the chamber about an axis of nutation through a center of nutation, the center of nutation being displaced along the axis of nutation from the plate, the plate including an attachment hub concentrically positioned in the plate and holes radially adjacent to the hub and extending through the plate;

a drive coupling fixed to the attachment hub and including two shaft sections telescoping together, the plate being fixed to a first of the two shaft sections;

a compression spring between the two shaft sections;

a mounting for mounting the drive coupling for nutation of the plate within the chamber about an axis of nutation, the mounting including a first portion fixed relative to the chamber housing and a second portion fixed relative to the first of the two shaft sections;

a shaft housing fixed relative to the chamber housing;

a drive shaft rotatably mounted in the shaft housing about the axis of nutation;

a rotor fixed to rotate with the drive shaft about the axis of nutation, the second of the two shaft sections of the drive coupling being rotatably mounted to the rotor radially displaced from the axis of nutation.

15. The pump of claim 14, the compression spring biasing the first portion and the second portion together.

16. The pump of claim 14 further comprising a bellows shaft seal about the drive coupling about the center of nutation and extending from the drive coupling to the chamber housing.

17. The pump of claim 16, the bellows shaft seal extending longitudinally of the drive coupling across the center of nutation.

18. A pump comprising a chamber housing including a chamber, an axial inlet to the chamber and a peripherial outlet from the chamber;

a plate mounted for nutation within the chamber about an axis of nutation through a center of nutation, the center of nutation being displaced along the axis of nutation from the plate;

a shaft housing fixed relative to the chamber housing;

a drive shaft rotatably mounted in the shaft housing about the axis of nutation;

a drive coupling including two shaft sections telescoping together, the plate being fixed to a first of the two shaft sections;

a compression spring between the two shaft sections;

a rotor fixed to rotate with the drive shaft about the axis of nutation and rotatably engaged with the second of the two shaft sections radially displaced from the axis of nutation;

a first dynamic balancing ring including multiple weights movable within the first dynamic balancing ring at the rotor and rotating therewith;

a bellows shaft seal about the drive coupling extending longitudinally of the drive coupling across the center of nutation and from the drive coupling to the chamber housing;

a mounting for mounting the drive coupling for nutation of the plate within the chamber about an axis of nutation, the mounting including a first portion fixed relative to the chamber housing and a second portion fixed relative to the first of the two shaft sections.

19. The pump of claim 18, the compression spring biasing the first portion and the second portion together.

20. The pump of claim 18 further comprising a second dynamic balancing ring at the drive shaft and rotatable therewith and displaced from the first dynamic balancing ring.

21. The pump of claim 20, the rotor being counterweighted radially displaced from the axis of nutation diametrically from the drive coupling rotatably mounted to the rotor.

* * * * *